US011959231B2

(12) United States Patent
Shaw et al.

(10) Patent No.: US 11,959,231 B2
(45) Date of Patent: Apr. 16, 2024

(54) CONCRETE DOWEL PLACEMENT METHOD AND APPARATUS

(71) Applicant: Shaw & Sons, Inc., Costa Mesa, CA (US)

(72) Inventors: Ronald D. Shaw, Costa Mesa, CA (US); Jeff Counterman, Costa Mesa, CA (US)

(73) Assignee: Shaw & Sons, Inc., Costa Mesa, CA (US)

( * ) Notice: Subject to any disclaimer, the term of this patent is extended or adjusted under 35 U.S.C. 154(b) by 0 days.

(21) Appl. No.: 18/151,336

(22) Filed: Jan. 6, 2023

(65) Prior Publication Data

US 2023/0151559 A1 May 18, 2023

Related U.S. Application Data

(63) Continuation of application No. 17/035,056, filed on Sep. 28, 2020, now abandoned.

(60) Provisional application No. 62/990,902, filed on Mar. 17, 2020.

(51) Int. Cl.
*E01C 11/14* (2006.01)
*E04B 1/48* (2006.01)

(52) U.S. Cl.
CPC ..... *E01C 11/14* (2013.01); *E04B 1/483* (2013.01)

(58) Field of Classification Search
CPC ..... E01C 11/14; E04B 1/483
See application file for complete search history.

(56) References Cited

U.S. PATENT DOCUMENTS

| | | | | |
|---|---|---|---|---|
| 5,005,331 | A | 4/1991 | Shaw et al. | |
| 5,216,862 | A * | 6/1993 | Shaw | E04B 1/483 52/704 |
| 5,487,249 | A | 1/1996 | Shaw et al. | |
| 5,678,952 | A | 10/1997 | Shaw | |
| 5,791,816 | A | 8/1998 | McCallion | |
| 6,210,070 | B1 | 4/2001 | Shaw et al. | |
| 6,389,774 | B1 | 5/2002 | Carpenter | |
| 6,926,463 | B2 | 8/2005 | Shaw et al. | |
| 7,314,333 | B2 | 1/2008 | Shaw et al. | |
| 7,338,230 | B2 | 3/2008 | Shaw et al. | |
| 7,381,008 | B2 | 6/2008 | Shaw et al. | |
| 7,604,432 | B2 | 10/2009 | Shaw et al. | |
| 7,874,762 | B2 | 1/2011 | Shaw et al. | |
| 8,007,199 | B2 | 8/2011 | Shaw et al. | |
| 9,340,969 | B1 | 5/2016 | Shaw | |

(Continued)

FOREIGN PATENT DOCUMENTS

WO WO2019125959 A1 6/2019

*Primary Examiner* — Andrew J Triggs
(74) *Attorney, Agent, or Firm* — Stetina Brunda Garred & Brucker

(57) ABSTRACT

A concrete surface with a cold joint, dowel slip system and method for forming that surface are provided. Baseplates having tubular projections are fastened to at least one first form using fasteners extending part way into the first form, with the first form forming part of a periphery of a first concrete slab. When the first form is removed, the baseplates, projections and fasteners remain embedded in the first concrete slab. Slip dowels are inserted into the tubular projections and a second concrete is poured adjoining the first concrete slab, with the second concrete embedding the slip dowels, backplates and projecting distal ends of the fasteners and forming a cold joint.

20 Claims, 3 Drawing Sheets

(56) References Cited

U.S. PATENT DOCUMENTS

| | | | |
|---|---|---|---|
| 9,546,456 | B2 | 1/2017 | Shaw |
| 9,617,694 | B2 | 4/2017 | Shaw |
| 9,951,481 | B2 | 4/2018 | Shaw |
| D850,896 | S | 6/2019 | Shaw |
| 10,774,479 | B2 | 9/2020 | Shaw et al. |
| 10,858,825 | B2 | 12/2020 | Shaw |
| 2005/0214074 | A1 | 9/2005 | Shaw et al. |
| 2006/0275078 | A1 | 12/2006 | Shaw et al. |
| 2007/0134063 | A1 | 6/2007 | Shaw et al. |
| 2008/0085156 | A1 | 4/2008 | Shaw et al. |
| 2014/0248076 | A1 | 9/2014 | Shaw |
| 2015/0197898 | A1 | 7/2015 | Shaw |
| 2017/0096810 | A1 | 4/2017 | Shaw |
| 2018/0127926 | A1 | 5/2018 | Shaw |
| 2019/0024367 | A1 | 1/2019 | Shaw |
| 2019/0063006 | A1 | 2/2019 | Shaw |
| 2019/0186137 | A1 | 6/2019 | Shaw et al. |
| 2019/0186138 | A1 | 6/2019 | Shaw et al. |
| 2019/0271122 | A1 | 9/2019 | Shaw |
| 2020/0149228 | A1 | 5/2020 | Shaw |
| 2020/0299953 | A1 | 9/2020 | Shaw |
| 2020/0378120 | A1 | 12/2020 | Shaw et al. |

* cited by examiner

CONCRETE DOWEL PLACEMENT METHOD AND APPARATUS

CROSS-REFERENCE TO RELATED APPLICATIONS

This application is a continuation of U.S. application Ser. No. 17/035,056, filed on Sep. 28, 2020, which claims the benefit of U.S. Application No. 62/990,902, filed on Mar. 17, 2020, the entire contents of which are expressly incorporated herein by reference.

STATEMENT RE: FEDERALLY SPONSORED RESEARCH/DEVELOPMENT

Not Applicable

BACKGROUND

The present disclosure relates generally to a method and apparatus for use in concrete construction, and is more specifically directed to a method and apparatus for placing slip dowels into horizontal concrete slabs.

In construction, a "cold joint" in concrete is a weakened interface between two sections of a generally horizontal concrete surface slab that harden at different times. Typically, a concrete surface is formed by pouring concrete into a form of a desired shape, finishing the concrete surface and allowing the concrete to harden within the form. When the area of the concrete surface becomes large, or for other reasons, it is sometimes desirable to form the concrete surface by pouring it piecewise in adjacent sections at different times, allowing each adjacent section to harden to some extent before the next adjacent section is poured and allowed to harden. The interface between a previously poured adjacent section of concrete and a more recently poured adjacent section is called a cold joint.

A cold joint in concrete is typically weaker under tension and under vertical loads than concrete that has been allowed to harden without any cold joints, and this weakness at the cold joint may cause problems after the concrete hardens. Due to this weakness, over time cold joints often become uneven or buckled due to thermal expansion and contraction of the concrete. Compaction of the underlaying soil caused by improper substrate preparation before pouring the concrete can also cause buckling or cracking at the cold joint as adjacent sections of the concrete shift vertically relative to one another. Further, too much water moisture may accumulate on the end face of the first concrete section before a second, adjacent concrete section is poured and hardens. If the accumulated water freezes, undesirable cracking in the concrete may occur due to ice expansion against the concrete. Also, in terms of aesthetics, cold joints often form a visual line at the interface of the two concrete sections, which is often undesirable.

To resist buckling, bulging, and vertical or horizontal displacement of adjacent concrete sections at the cold joint, it is common to insert long steel rods, known as "slip dowels," into the edge portions of adjacent concrete sections so that the concrete sections may slide freely along one or more of the slip dowels. This ability to slide freely may allow linear expansion and contraction of the concrete sections in the plane of the concrete surface, while substantially maintaining the concrete in a common plane, thus preventing undesirable buckling, bulging, or unevenness at the cold joint.

To function properly, it is important to properly position the slip dowels within adjacent concrete sections. For instance, most slip dowels are placed in substantially parallel alignment relation to each other to allow the concrete sections to slide along the length of the slip dowels while resisting movement of the concrete in a direction orthogonal to that length. Thus, the purpose of placing the slip dowels is defeated when the dowels are not properly positioned in substantially parallel relation to each other because, in such a case, the concrete sections are not able to slide along the slip dowels. Further, nonparallel placement of slip dowels can cause cracking in the concrete as well as faulting, i.e., misalignment of the concrete sections at the cold joint.

In the prior art, the methods for installing slip dowels include drilling holes for the slip dowels into a side of a first adjacent concrete section after removing the concrete forms, or forming cavities in the side of the first adjacent concrete section into which the slip dowels are inserted after the concrete hardens and the concrete forms are removed. A second adjacent concrete section is then poured to embed the end of the dowel extending from the first concrete section. The concrete forms are often a finished, wooden 2×4 inch or 2×6 inch stud. Such studs are typically smaller than nominal size because finishing the studs to a smooth finish reduces the nominal size of the stud, so the concrete slabs formed with the finished studs is thinner than the nominal size of the stud. For road paving, the forms may be metal and 8 to 12 inches high, or higher. The depth and diameter of the individual holes are typically least twelve inches deep and typically have a diameter of approximately one-half to five-eighths of an inch for foot traffic, and ¾ to one inch diameter for vehicle traffic.

The methods and apparatus of the prior art have various disadvantages, including one or more of time consuming installation techniques, misalignment errors, requiring expensive inserts to form cavities for the dowels, requiring heavy inserts to form the cavities and requiring large inserts to form the cavities, and requiring expensive installation techniques, to name a few. There is thus a need for an improved method and apparatus that reduces installation time and expense, and uses less expensive components. Accordingly, there remains a need in the art for methods and/or systems for facilitating the proper placement of slip dowels, and methods for manufacturing such placement systems, which overcome the previously described deficiencies associated with prior art placement devices and systems.

BRIEF SUMMARY

The present disclosure is best understood by reference to the following detailed description when read in conjunction with the accompanying drawings.

An improved concrete surface with a cold joint, a dowel slip system and a method for forming that surface are provided. Relatively thin baseplates having tubular projections are fastened to at least one first stud using fasteners extending part way into the first stud, with the first stud forming at least part of a periphery of a first concrete slab. When the first stud is removed the baseplates, projections and fasteners remain embedded in the first concrete slab. Slip dowels are inserted into each of the tubular projections through a hole in the baseplate aligned with the longitudinal axis of the tubular projection and a second concrete is then poured adjoining the first concrete slab. The second concrete embeds or entrains the slip dowels, backplates and projecting distal ends of the fasteners and when hardened to form the second concrete slab, forms a cold joint between the first and second concrete slabs.

There is thus advantageously provided a concrete dowel placement system that includes one or more finished 2×4 or 4×6 studs having a stud length with opposing first and second side walls and opposing top and bottom edge walls. The system also includes a plurality of baseplates each having opposing front and back sides with a relatively thin thickness typically between 0.1 and 0.25 inches. The baseplates are preferably made of a polymer which does not split or crack when a fastener is forced through the baseplate. Each baseplate has an outer periphery which is located between the top and bottom edge walls of the stud and 0.5 inches or more from the top edge wall of the stud. One or more fasteners are preferably fasteners forced through each of different ones of the baseplates fasten the baseplate to the first side wall of the stud so the planar periphery cooperates with the first side wall of the stud to which the baseplate is fastened to form a seal that inhibits the entry of poured concrete between the baseplate and stud. Each fastener has a fastener length which extends into the stud a distance of at least ¼ inch and less than 1 inch. A separate tubular projection extends from each respective baseplate along a longitudinal axis that is substantially perpendicular to the front face of the baseplate from which the projection extends. Each tubular projection has a length of preferably between 4 to 9 inches with a closed distal end and a hollow interior configured to receive a cylindrical shaft having a diameter between 0.2 to 0.4 inches and preferably being 0.25 to 0.375 inches in diameter.

In further variations of this system, the three fasteners extend a distance of 0.3 to 0.5 inches into the stud and comprise nails or staples or both. The hollow interior may also be configured to receive a shaft 0.2 to 0.3 inches in diameter. Advantageously, the tubular projections have engagement features to better entrain the tubular projections in the concrete. The tubular projections may also be spaced at 18 inch intervals along the stud length. Further, there are advantageously only three staples holding each of the baseplates to the stud.

There is also provided an improved concrete surface having first and second concrete slabs joined by a cold joint. The is improved concrete surface includes a plurality of polymer baseplates embedded in the first concrete surface at intervals along the cold joint. Each baseplate has an outer periphery located at least 0.5 inches from a top surface of the first slab of concrete at the cold joint. Each baseplate also has a tubular projection extending perpendicular from the baseplate and into the first concrete slab. Each tubular projection has a length of 4 to 9 inches. Each baseplate also has multiple fasteners preferably at least three fasteners extending from the first concrete surface, through the baseplate and into the second concrete surface a distance of 0.2 to 1 inch with a head of each fastener embedded in the first concrete slab and distal ends of a further plurality of these fasteners embedded in the second concrete slab. The system also includes a plurality of straight, stainless steel or fiberglass slip dowels having first and second opposing ends and a length of preferably between 4 to 18 inches. The second end of each slip dowel is embedded in the second concrete slab while the first end extends into a different one of the tubular projections. Each slip dowel has a diameter of 0.2 to 0.4 inches, but preferably is either 0.25 or 0.375 diameter stainless steel and/or fiberglass, although other metal or non-metal dowels are contemplated. The sequence of steps in assembling or attaching the baseplate to the at least one concrete form and using it to form part of the periphery of the first concrete surface, can vary.

In further variations, the improved concrete surface has the slip dowels made of stainless steel with a diameter of 0.2 to 0.3 inches. The slip dowels may alternatively be made of fiberglass and have a diameter of 0.2 to 0.3 inches. Advantageously, the fasteners extend the through the baseplate and into the second concrete surface a distance of 0.25 to 0.6 inches.

There is also provided a method of forming a cold joint between adjoining sequentially formed first and second slabs of concrete. The method includes the steps of arranging a at least one stud to form at least a portion of a periphery of the first slab of concrete. The method also includes the step of fastening a plurality of baseplates to the at least one stud with a plurality of at least three separate fasteners forced through each respective baseplate and into the stud to which the baseplate is fastened. Each baseplate has opposing front and back sides with a thickness of between 0.015 and 0.25 inches. Each baseplate is made of a polymer which does not split or crack when each fastener is forced through the baseplate and into the stud. Each baseplate has an outer periphery which is located between a top and bottom edge wall of the stud and 0.5 inches or more from a top edge wall of the at least one stud. Each fastener has a fastener length which extends into the stud a distance of at least ¼ inch and less than 1 inch. Each baseplate has a tubular projection extending along a longitudinal axis that is substantially perpendicular to the front face of the baseplate from which the projection extends. Each tubular projection has a closed distal end and a hollow interior configured to receive a straight cylindrical shaft 0.2 to 0.4 inches in diameter through an opening in the baseplate. Each tubular projection has a length of 4 to 9 inches from the baseplate and has a sidewall thickness less than 0.1 inches.

The method includes pouring a first concrete area bounded partially by the at least one stud to entrain the plurality of baseplates and tubular projections. The poured first concrete is then leveled and finished to form the first concrete slab upon hardening of the first concrete, with the tubular projections extending into the first concrete slab. The method also includes removing the first plurality of studs, leaving the baseplates embedded in the first concrete slab along a first edge of the first concrete slab, with distal ends of the fasteners extending from the respective baseplates along that first edge of the first concrete slab.

In one further variation, the method also includes inserting a slip dowel into each tubular projection through the hole in the baseplate, with each slip dowel advantageously having a diameter of 0.2 to 0.4. The dowels may be made of stainless steel or fiberglass and may have a length of 12-18 inches. Each tubular projection is advantageously configured to slidingly but tightly receive the slip dowel. This one further variation also includes pouring a second concrete to entrain the slip dowels and the distal ends of plurality fasteners, and then leveling and finishing the second concrete to form the second concrete slab upon hardening of the second concrete.

In further variations of either of the above methods, the slip dowels are preferably made of metal and preferably stainless steel and have a diameter of 0.2 to 0.3 inches. The slip dowels may alternatively be made of fiberglass or other resin/polymer material and have a diameter of 0.2 to 0.3 inches. Advantageously, the method includes using only multiple and preferably three fasteners to hold each baseplate to the at least one stud. Preferably, the fasteners have a length of 0.2 to 0.5 inches extending into the stud, projecting from the first concrete edge, and embedded in the second concrete surface. Advantageously, the fasteners are nails or staples.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
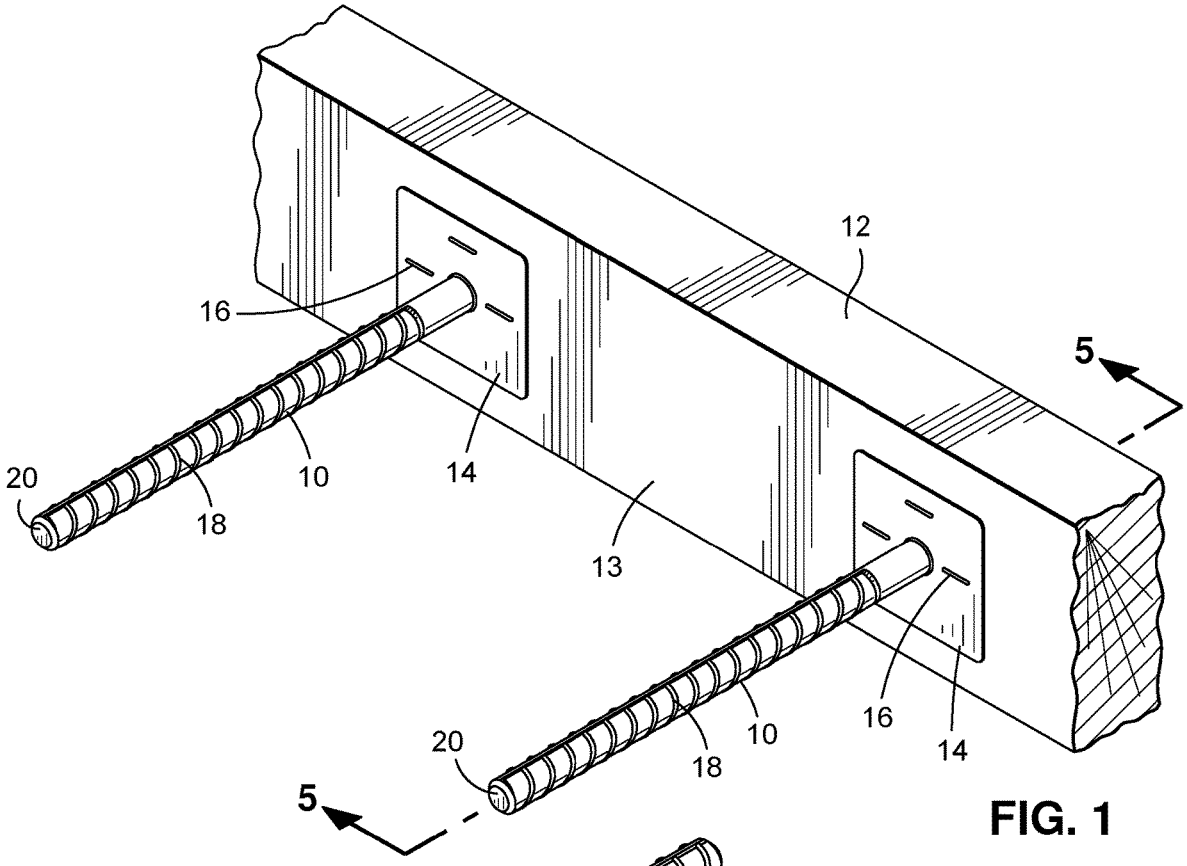
FIG. 1 is a front perspective view of two tubular projections each preferably having a textured exterior surface and extending from a baseplate stapled to a concrete form.
Figure 2:
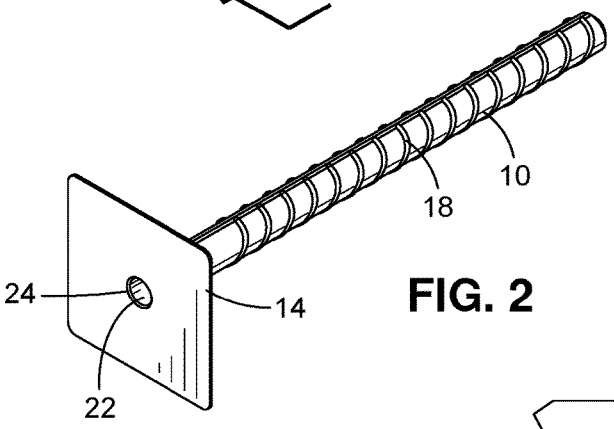
FIG. 2 is a rear perspective view of one of the tubular projections and baseplates of FIG. 1, without the concrete form.

As used herein, the following part numbers refer to the following parts throughout: 10—tubular projection; 12—concrete form; 13—vertical side of form; 14—baseplate; 15—ground; 16—fastener; 18—engagement feature; 20—distal end of projection; 22—open proximal end of projection; 24—opening in baseplate; 26—first concrete; 30—slip dowel; and 32—second concrete.

Referring to FIGS. 1-3 and 5-6, a tubular projection 10 extends along a longitudinal axis perpendicular to the vertical side of a concrete form 12. The inside of the projection 10 is preferably smooth with a uniform cross-section along all or almost all (i.e., 90%) of the axial length of the projection. The tubular projection extends perpendicularly from a baseplate 14 which is fastened to the flat, vertical side 13 of the concrete form 12 on the side of the form adjoining the concrete when it is poured into the form. Advantageously, a plurality of fasteners, such as staples 16, tacks or short nails are used to fasten the baseplate 12 to the concrete form 12. The projection 10 advantageously has one or more optional ribs or engagement features 18 on the exterior side of the projection 10 to better interlock with the concrete that is poured there-around to entrain the projection during use and reduce concrete cracking. The figures show the engagement feature 18 as a continuous helical rib 18 extending along and encircling the projection 10 like a single external thread. The tubular projection 10 advantageously has a closed distal end 20 and an open proximal end 22 which coincides with an opening 24 in the baseplate 14 providing access to the hollow interior of the tubular projection 10.

Figure 8:
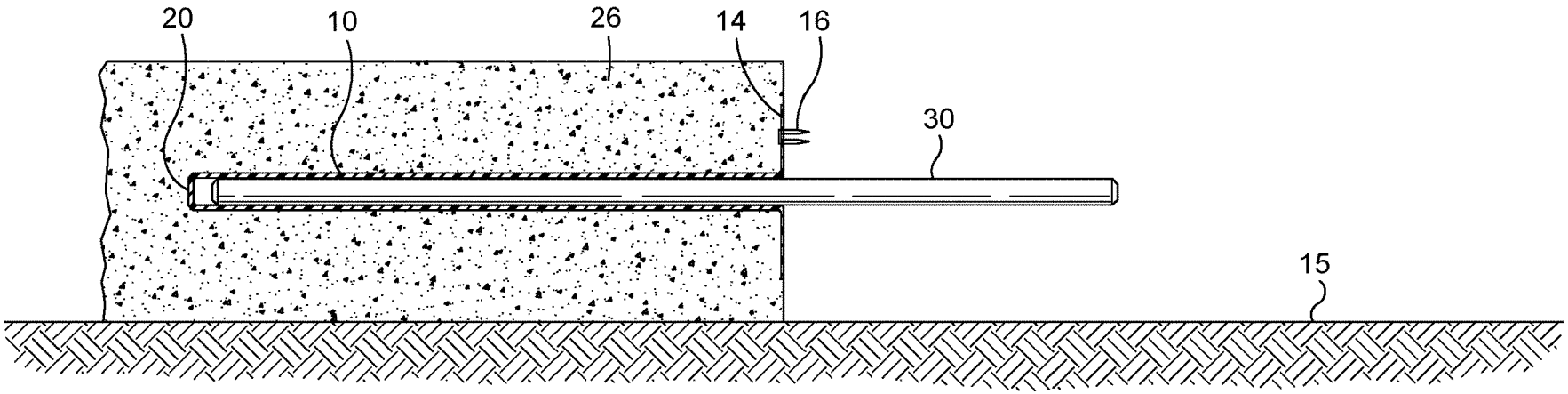
FIG. 8 is the sectional view of FIG. 7 with a dowel inserted into the projection and a free end extending parallel to the exterior surface of the first concrete surface.
Figure 9:
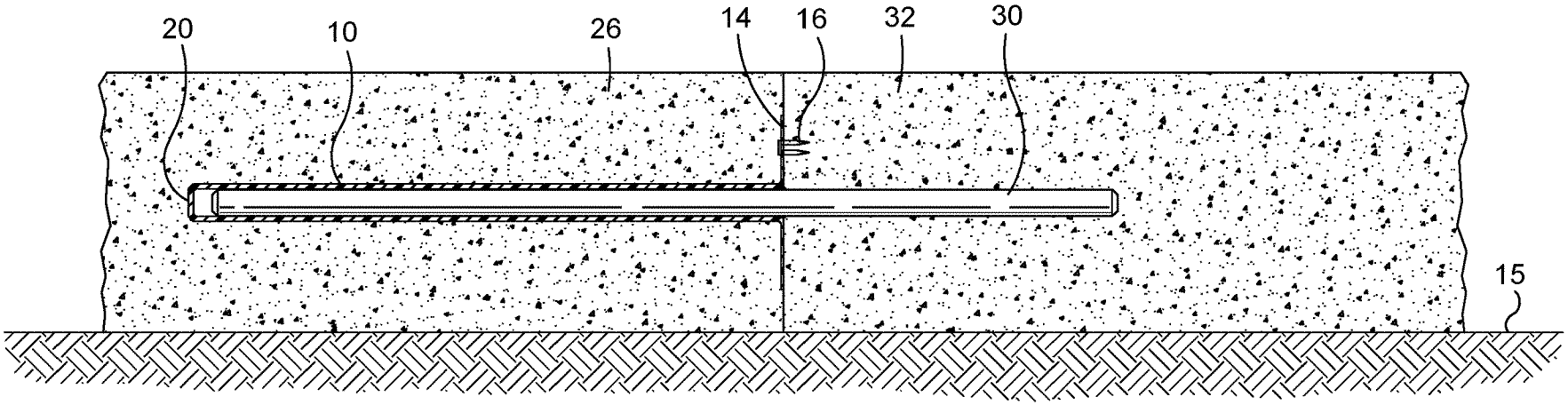
FIG. 9 is the sectional view of FIG. 8 with a second, adjacent concrete surface embedding what was the free end of the dowel of FIG. 8.

The hollow interior of the projection 10 is preferably cylindrical, having a diameter sufficient to receive and allow axial motion of a dowel pin 30 (FIGS. 8-9) having a diameter between 0.2 to 0.499 inches, and preferably a diameter of 0.2 to 0.3 inches, with a conventional standard sized diameter of ¼ inch to ⅜ inch believed preferable. The preferred diameter is ¼ inch or ⅜ inch. These diameters are subject to slight variation arising from manufacturing tolerances, which variation are typically less than 5%. The projection 10 preferably has a length of 4 to 9 inches, with a length of 4 to 6 inches preferred.

Figure 3:
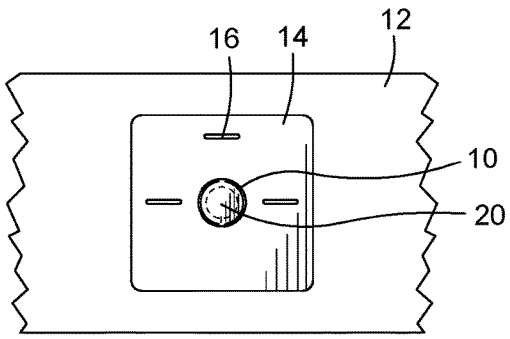
FIG. 3 is a front view along the longitudinal axis of one of the tubular projections of FIG. 1.
Figure 4:
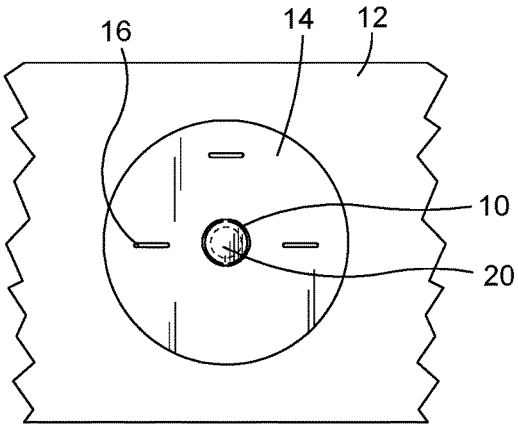
FIG. 4 is a front view along the longitudinal axis as in FIG. 3, but showing a circular baseplate on a larger concrete form.

Referring to FIGS. 3-4, the baseplate 14 although being formed having any desired configuration advantageously has a rectangular shape of its outer periphery when the concrete form 12 is a 2×4 stud, and advantageously has a circular shape when the concrete form is a 2×6 stud, and in both configurations the tubular projection 10 extends from the center of the baseplate. The baseplate shapes may be used to help align the projections in approximately the same vertical plane, advantageously the midplane of the concrete slab formed by the concrete forms 12, with preferably coincides with the midline along the length of the concrete forms 12, or close thereto (i.e., within ½ to ¾ inch). The rectangular shape (which includes a square) allows a user to more easily center or align a plurality of projections 10 on the concrete form 12 by visually using the same distance from the top or bottom edge of the baseplate to the respective top or bottom of concrete form—the 2×4 stud. The user could also visually center the baseplate 14 by visually comparing the distance between the top and bottom of the concrete form and the adjacent, straight and parallel sides of the baseplate.

The circular shape of the circular baseplate 14 allows a reduction in the material used to form the baseplate, while still allowing the user to visually locate the baseplate 14 and projection 10 at the same midplane location as the rectangular shaped baseplate. A user may visually locate the circular baseplate 14 to have the same distance between the top (or bottom) of the concrete form, and preferably to visually locate the circular baseplate to have an equal distance between the top and bottom of the baseplate and the respective top and bottom of the concrete form.

Preferably the thickness of the baseplate 14 is relatively thin, i.e. preferably between 1/64 of an inch to ¼ of an inch to reduce material costs and enable conventional staples/nails to easily penetrate the baseplate during installation to the 2×4 or 2×6 concrete form as described below.

Referring to FIGS. 1 and 3-7, the baseplate 14 is fastened to one of the concrete forms 12 by plural conventional fasteners 16, with the baseplate having a flat surface adjoining the concrete form 12 so the tubular projection 10 is held by the baseplate substantially perpendicular to the vertical side 13 of the concrete form 12. As used herein, "substantially perpendicular" includes angular variations of 10° and less. Advantageously, at least two and preferably three fasteners 16 surround or encircle the juncture of the projection 10 and baseplate 14. Advantageously, the baseplate 14 is stapled by fasteners 16 which are driven through the baseplate 14 and a short distance (i.e., 0.2 to 0.6 inches) into the concrete form 12, with the fasteners advantageously extending ¼ to ½ inches past the baseplate and into the concrete form 12, and preferably extending ⅜ inches into the concrete form. Fasteners extending a distance of 0.2 to 1 inch are believed usable, but the longer lengths make it more difficult to strip the concrete forms from the embedded fasteners.

The fasteners 16 preferably comprise conventional staples which can be quickly applied from above the concrete forms 12 using conventional mechanical/pneumatic or electric staplers. However, conventional nails may be additionally utilized preferably utilizing a conventional nail gun (not shown).

The fasteners 16 extend into and are entrained in the second poured concrete 32 as it hardens to further hold the projection 10 and baseplate 14 in position, and to provide a small, localized interlock across the cold joint formed between the adjoining edges of the first and second concrete slabs 26, 32 when the slabs harden. The short length of the fasteners 16 and the small cross-sectional size or diameter of the fasteners 16 are such that the fasteners do not initiate or propagate cracks in the first or second concrete slabs 26, 32 when the slabs harden or thereafter. Further, the short length of the fasteners 16 are selected so the length does not extend much beyond half of the lateral thickness of the concrete form 12 when the baseplates 14 are fastened to the concrete form or stud 12. Longer fasteners and fasteners with larger cross-section sizes make removal of the concrete form or stud 12 more difficult and also can leave the fasteners bent or curved to differing amounts because the concrete forms are typically removed by moving a first end of the form laterally away from the first concrete 26 and pivoting that first end about an opposing second end of the form with the result that the fasteners adjacent the first end of the form are straight or fairly straight, but the fasteners toward the second end of the form may be curved—depending how the studs 12 are removed. Curved fasteners 16 entrained in the second concrete 32 will resist relative movement of the first and second hardened concrete slabs 26, 32 along an axis parallel to the slip dowel 30 of the projection and baseplate to which the fasteners are connected, and that resistance of movement is believed to present a risk of crack initiation or spalling. Further, the fasteners 16 are made of metal, typically iron, steel or stainless steel and the thermal expansion of the metal fasteners is much greater than that of the concrete 26, 32. By keeping the size of the fastener cross-section small as described, and by reducing the length, it is believed that potential cracking and spalling from the thermal expansion of the fasteners is reduced.

Thus, the fasteners 16 are preferably long enough in length, and large enough in cross-sectional size or diameter so that the baseplate and projection are held securely to the concrete form 12 for pouring of the concrete, but are small enough in length and cross-section to allow easy manual separation from the concrete form 12 after the first concrete 26 hardens with the separation occurring so the protruding portion of the fasteners are substantially straight and parallel to the axis of projection 10. The fasteners 16 are also selected so they extend a short enough distance into the second concrete 32 that they provide some concrete interlock around the baseplate 14 while not extending far enough into the second concrete 32 or having a large enough cross-section that they may cause or contribute to cracking or spalling at the fastener locations as the concrete slabs 26, 32 move along the length of the projections 10 and slip dowels 30, or as the concrete slabs expand and contract with temperature changes that can exceed 100° F.

The second concrete 32 entrains the baseplates 14 to the extent that the baseplates extend beyond the edge of the first concrete 26 as may occur if the baseplate is deformed during removal of the concrete form 12 after the first concrete 26 hardens. The second concrete 32 entrains any deformed baseplate 14 and enters any opening or recess or pocket in the baseplate that faces the edge of the second concrete 32 after the concrete form 12 is removed. The tight fit, but slip fit, between the hollow inside of the tubular projection 10 and the slip dowel 30 is small enough that while some cement may enter the inside of the projection, the amount of any such cement is small enough that it does not prevent relative movement of the slip dowel 30 inside the tubular projection 10.

The baseplate 14 advantageously has no fastener holes preformed in the baseplate for the staples or for the fasteners 16 so that the shafts of the fasteners 16 are forced through the material of the baseplate and create their own hole through the baseplate. A plurality of projections 10 and their baseplates 14 are fastened to the concrete form 12 with the projections 10 preferably located in the same general plane at or preferably within one inch of the midplane of the planned concrete slab for a 2×4 concrete form 12 or stud, and within two inches of the midplane of the planned concrete slab for a 2×6 concrete form or stud. Three fasteners 16 are believed suitable to hold the baseplate 14 to the concrete form 12, with the three fasteners located about 120° apart, with one fastener at the top center of the baseplate. The use of "about" in reference to the fastener spacing is with respect to the longitudinal axis along the centerline of the projection 10, and encompasses a variation of 20 degrees either direction from the equidistant position achieved by the preferred 120° spacing. Advantageously, the three fasteners 16 are located with at least one fastener above the horizontal plane through the centerline along the length of the projection 10 and at least two fasteners 16 below that plane. But other arrangements may be used, including one fastener on a first side of a vertical plane through the centerline of the projection 10 and two fasteners on an opposing, second side of that vertical plane. As will be recognized by locating the fasteners in such a manner, the fasteners can be quickly applied from above the concrete forms using a conventional staple or nail gun (not shown).

The rectangular baseplate 14 allows multiple, i.e., preferably three fasteners 16 to be manually driven through the baseplate 14 by a worker kneeling over the stud and projection when the stud is on the ground (or other surface on which the concrete is poured) and the sides 13 of the studs or concrete forms 12 are vertical, and a fastener 16 through each corner of the baseplate extending into the stud forming the concrete form 12 provides for a sturdy connection that aligns the projection 10 perpendicular to the side 13 of the stud and that inhibits entry of the concrete between the baseplate and the stud as may block or hinder access to the hollow projection 10. Three staples or fasteners may be similarly applied easily to a circular baseplate 14.

Figure 5:
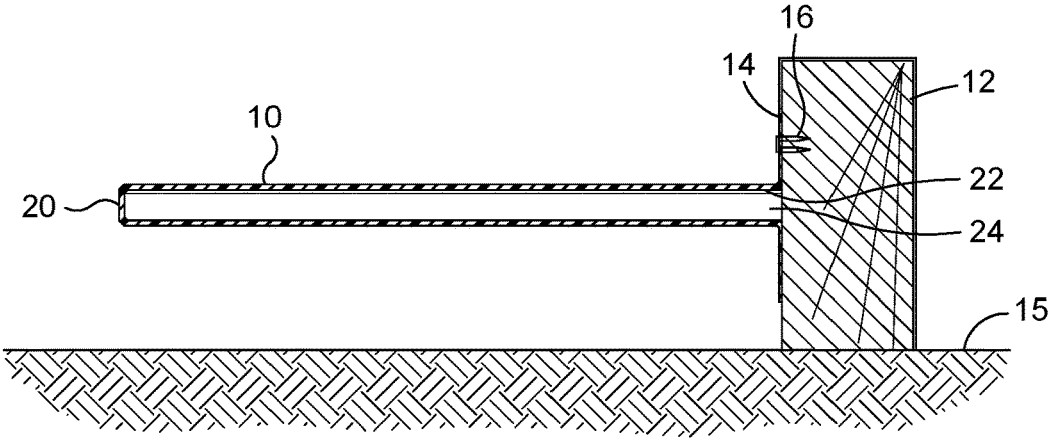
FIG. 5 is a sectional view taken along section 5-5 of FIG. 1.
Figure 6:
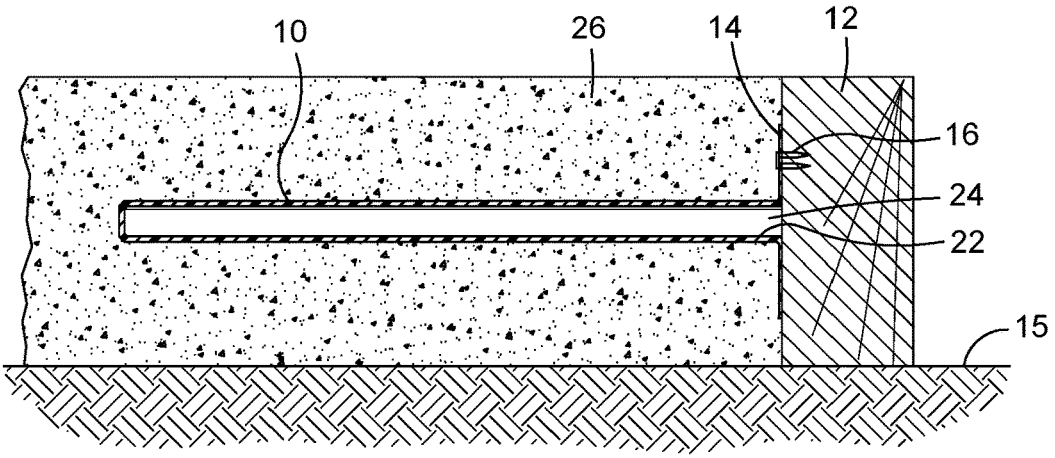
FIG. 6 is the sectional view of FIG. 5 showing the projection and baseplate embedded in a first concrete surface with the concrete form attached to the baseplate.

As shown in FIGS. 5-6, after the projection 10 and baseplate 14 are fastened to the concrete form 12, uncured first concrete 26 is poured into the forms 12 to entrain the projections 10. The exterior surface of the first concrete 26 is finished while the concrete is still wet and pliable enough to be altered. The exterior surface of the first concrete 26 is typically finished flat with the top surface of the concrete form 12 or parallel to that top surface of the form 12.

Figure 7:
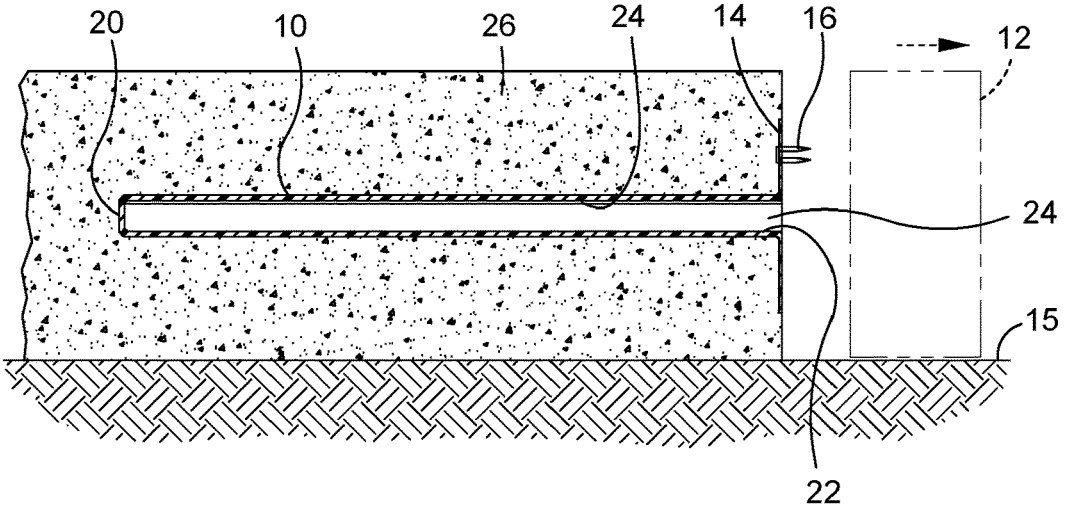
FIG. 7 is the sectional view of FIG. 6 with the concrete form removed.

Referring to FIG. 7, the wet first concrete 26 flows around the engagement features 18 on the projection 10 to interlock with the first concrete 26 as it hardens. When the concrete hardens, the hardened first concrete 26 interlock with the engagement features 18 to restrain movement of the projection 10 along the length of the projection 10. The wet first concrete 26 also flows around the edges and inward facing portion of the baseplate 12. But the baseplate 12 has a flat back that is fastened to the flat side of the concrete form 12 so no concrete flows between the baseplate and the concrete form.

When the concrete hardens sufficiently to support a person's weight without deformation, or as otherwise specified by the concrete requirements, the concrete forms 12 are removed, i.e., stripped from the first concrete 26. As the projections 10 and periphery of the baseplates 12 are embedded in the first concrete 26 and as the projections and baseplates are permanently connected, the projections and base plates remain embedded in the first concrete 26 when the form is removed. The fasteners 16 also remain embedded in the first concrete 26 and project outward from the vertical surface of the concrete slab.

A slip dowel 30 is then inserted into the hollow inside of each tubular projection 10. The slip dowel 30 is preferably a fiberglass or stainless steel rod, 0.2 to 0.499 inch diameter, and preferably ¼ or ⅜ inch diameter. The slip dowel material and diameter are preferably selected so each slip dowel has or provides a shear stress of 6000 psi. The slip dowel 30 is preferably cylindrical in shape, but other cross-sectional shapes may be used, including rectangular (which includes square shapes), hexagonal and oval shapes. The slip dowel 30 has a length of 12 to 18 inches and is inserted until an end of the dowel 30 hits the closed end 20 of the now embedded projection 10, with the installer preferably moving the dowel 30 outward, away from the closed end a movement distance, preferably a distance of 0.2 to 1 inches, with a movement distance of ¼ to ½ inch preferred. That leaves a length of the slip dowel 30 extending outward from the vertical side of the hardened first concrete 26 and a slight space between the interior end of the slip dowel and the closed end of the projection 10. An extending length of 6 to 9 inches is preferred, preferably about half the length of the dowel (i.e., within an inch of the center).

If the slip dowel 30 makes contact with the closed end of the projection 10, then thermal expansion of the dowel may be sufficient to create internal pressure on the concrete 26, 32 embedding the slip dowel, and may lead to cracking or buckling of the concrete. Thus, a slight space of 0.2 to 0.5 inches is preferred to exist between the closed end 20 of the projection 10 and the adjacent end of the slip dowel inserted into the projection, with the space being sufficient so that thermal expansion does not cause the slip dowel 30 to contact the closed end 20. The short gap or space can help prevent undesirable pressure between adjoining concrete sections that may be caused by the slip dowel 30 pressing against the end of the projection 10 when the concrete expands. Such pressure can potentially expedite undesirable weakening of the concrete.

After a slip dowel 30 is placed inside each of the projections 10, then a second wet concrete 32 is poured into a set of forms adjoining the first concrete 26, to form a second concrete slab. The second concrete 32 entrains the previously exposed end of the slip dowel 30 and the distal ends of the fasteners 16 extending beyond the back of the baseplate 14. If the distal ends of the fasteners are not bent over, they extend about 0.2 to 0.8 inches into the second concrete 32 and provide further concrete interlock between the first and second concrete slabs 26, 32 along the length of the fasteners. The exposed surface of the second concrete 32 is finished while pliable, and usually finished to create a continuous exterior surface with the first concrete 26. After the second concrete 32 hardens, the concrete form 12 or forms for that second concrete are removed.

The projection 10 may be temporarily fastened to the slip dowel 30 by friction or by other means of temporary attachment, such as low strength adhesives or other adhesives applied over a small area so that a small force of under 5 or 10 pounds can cause relative axial movement between the projection and slip dowel. One of ordinary skill in the art will appreciate that the fit between each slip dowel 30 and its corresponding projection 10 is tight enough and sealed enough so that it is unlikely that pourable concrete can leak into the inside of the projection 10 and into the space between the projection and the slip dowel inserted into the projection when the concrete is poured and the slab hardens. Concrete leaking into the interior of the projections can negatively impact one of the functions of the concrete dowel system, which is to allow slip dowels 30 to slide freely within the projections 10. Further, the fasteners 16 holding the baseplate 14 and projection 10 to the concrete form 12 is strong enough such that the pouring of the concrete does not break or disrupt the connection and cause misalignment of one or more of the projections 10.

As the concrete 26, 32 expand and contract, the slip dowels 30 move along the length of their respective projections to allow movement along the longitudinal axes of the projections, which axes and projections are aligned in the same plane. As a weight moves horizontally across the joint from the first concrete 26 to the second concrete 32 (e.g., a person walking, or a light vehicle), the slip dowels 30 interlocked with the concrete distribute that vertical load across the juncture of the concrete and into the adjacent first and second concrete in which the slip dowels and projections are entrained.

By using small diameter slip dowels 30, the weight of the dowels that must be supported in position by the baseplates 14 is reduced sufficiently so that the baseplates 14 may hold the projections 10 in a sufficiently perpendicular position relative to the vertical side 13 of the concrete forms 12 to avoid cracking of the concrete 26, 32 when the concrete expands and contracts and when vertical loads traverse the joints between adjoining concrete slabs 26, 32. By selecting the thickness and size of the baseplate 14 to support this reduced weight of the slip dowel 30, the baseplate may be more quickly fastened to the concrete forms 12 and be less costly to fabricate than in the prior art. An installer may use a conventional hammer stapler to drive a two-pronged staple of fastener 16 through the baseplate 14 and into the wooden stud of the concrete form 12 with each swing of the hammer stapler. That provides for much faster installation that in the prior art. 9/16 wide crown staples are believed suitable. Finish nails with lengths of 0.5 to 1 inch and diameters of 0.05 to 0.1 inches are believed suitable for the fasteners 16, as is a 2d penny nail, finish nail, casing nail, box nail or brad. As used herein, a reference to a nail includes these various types of nails, tacks and brads. A 2d penny nail is believed to have a diameter of 0.07 inches, and staples with the same diameters or cross-sectional areas on each of the prongs or legs of the staples are believed suitable. As used herein, a staple is considered as one fastener even though it has two prongs. It is contemplated that irrespective of the particular type of fastener being used, it will be installed using a conventional staple or nail gun for quick installation.

The fasteners 16 and baseplate 14 remain embedded in the concrete so there is a vertical separation surface on the slab of first concrete 26. There are no large voids in the edge of the first concrete formed by a removable baseplate as in the prior art, and there is no need to pry any broken pieces of a removable baseplate out of the concrete as in the prior art. The fasteners 16 are short in length and small in diameter so little force restrains the separation of the concrete form 14 from the hardened first concrete 26 as the form 14 is stripped away from the edge of the hardened slab of the first concrete 26. The tips of the fasteners 16 project from the vertical side of the hardened slab of first concrete when the form 14 is removed. But the fasteners 16 are short in length, small in diameter, are easily bent sideways so the temporarily exposed fastener tips do not easily penetrate the boots worn by construction workers. The tips of the fasteners are exposed only for the short time between removing the form 14 and pouring the adjacent or adjoining second concrete 32. Thus, the time needed to install and remove the projections 10 and forms 12 is reduced. Further, the exposed tips of fasteners 16 are easily bent sideways so a worker with a hammer, club or steel-toed shoe can quickly bend them sideways or downward to further reduce any potential adverse contact with the exposed fastener tips.

The length of the exposed tips of fasteners 16 are short enough that while they are entrained in both the first and second concrete 26, 32, the fasteners 16 are believed small enough, especially relative to the aggregate size typically used with the described concrete forms 12, so the fastener tips are believed not to cause any cracks to propagate to the exterior surface of the adjoining concrete slabs under temperature changes and as vertical loads pass over the joint between adjoining first and second concrete slabs.

There is thus advantageously provided a method and apparatus for more quickly installing a interlock system of slip dowels 30 and hollow projections for receiving those dowels, in adjacent slabs of concrete 26, 32. The interlock system has the projections 10 aligned sufficiently perpendicular with the concrete forms 12 and slip dowels 30 so that adjoining first and slabs of concrete 26, 32 do not crack under the temperate variations or under the vertical load variations for which such slabs are conventionally designed.

Several of the parts are described in more detail below. The projection's opening 24 is advantageously the same size as is the interior of the tubular projection 10, but to make it easier to insert the slip dowel 30 into the inside of the tubular projection, the opening 24 could be slightly larger in cross-sectional dimension (i.e., 5% to 20%) than the hollow interior dimension of the tubular projection and tapered like a funnel. Any tapered length is advantageously short and preferably 0.25 to 0.5 inches long as measured from the side of the baseplate 14 adjoining the concrete form 12 during use. Advantageously, both opposing ends of the slip dowel 30 are not square, and are instead rounded and preferably chamfered at 30°-45° for a short length of an eighth of an inch or less, to make insertion into the inside of the projection 10 easier and to allow either end of the slip dowel to be inserted into the projection.

The distal end 20 of projection 10 advantageously has a rounded or chamfered external end. The avoidance of sharp corners is believed to reduce potential cracking locations. The closed end 20 of the projection 10 may be integrally formed with the projection 10, or may be achieved by fastening an end cap over the distal end of the tubular projection. Such an end cap may comprise a piece of duct tape or construction tape, a cap, a plug, a piece of film, or any blockade that is either permanently affixed or removably attached to the distal end of the projection 10.

The tubular projection 10 is advantageously made of a polymer material as is the baseplate 14. Advantageously, the baseplate 14 and tubular projection 10 are integrally molded in a single pour injection molding process to form a unitary, simultaneously molded structure, so the open proximal end 22 of the projection 10 is the same as the opening 24 in the baseplate. The tubular projection 10 could be formed separately with its longitudinal axis centered on and the projection fastened around the opening 24 in the baseplate 14, as by welding or spin welding, or less desirably by adhesives, by nesting the projection inside an encircling cylindrical flange on the baseplate, or other fastening mechanisms.

The projection 10 into which the slip dowel 30 is sheathed may have any cross-sectional shape, although advantageously the cross-sectional shapes for the projection and dowel are the same. Circular-cross-sectional shapes are preferable, with just enough space between the slip dowel 30 and the inner wall of the sheathing projection 10 to allow easy insertion by the installers and to allow movement during use that does not cause or propagate cracking. A spacing of 1 to 10 thousandths of an inch between the outer surface of the slip dowel 30 and abutting interior surface of the projection 10 is believed suitable with a spacing of 2 to 5 thousandths of an inch preferred when the parts are both aligned on the longitudinal centerline of the projection. If the spacing is too large then the slip dowel embedded in the second concrete 32 can shift position a greater distance before the dowel engages the tubular projection 10 in the first concrete 26 to interlock the adjoining concrete slabs. A smaller spacing provides a tighter interlock and greater strength. This spacing is affected by variations in the thickness of the sidewall of the tubular projection 10, which affects the diameter or cross-sectional size of the hollow interior of the projection 10. The sidewall thickness may vary depending on molding conditions and tolerances and the materials being molded. The sidewall of the tubular projection 10 advantageously has a thickness less than 0.1 inches and preferably less than 0.05 inches.

In use, gravity will cause the slip dowel to rest on and be slid along the bottom of the interior of the tubular projection 10. The inside of the tubular projection 10 need not be a smooth cylinder as the projection may have engagement features to better entrain the projection 10 in the concrete and the wall thickness of the tubular projection may be substantially uniform (subject to molding variations) resulting in portions of the projection's tubular wall that exceed the desired spacing for short (under 0.2 inches) portions of the length of the tubular projection 10. But the walls of the tubular projection 10 are sufficiently continuous along the length of the projection to support the slip dowel 30 substantially continuously along the length of the tubular projection 10 with the desired spacing. As used in this spacing context, the term "substantially continuously" refers to the desired spacing every 0.2 inches along at least 80% of the length of the tubular projection The ends of the dowel 30 can be rounded, tapered or otherwise configured to facilitate inserting the dowel into the inside of the projection 10. This spacing of one to ten thousands to support the slip dowel substantially continuously along the length of the tubular projection 10 allows the slip dowel to fit tightly but slidingly inside the tubular projection.

The projection 10 is shown with a single, helical wound engagement feature 18. A variety of configurations may be used for the engagement features 18, including an intermittent, helical would rib, and radial ribs encircling the projections' circumference in a continuous or intermittent manner. A plurality of wavy ridges and intervening valleys as found on rebar or structural reinforcing rods are also believed suitable. Engagement features extending outward from the longitudinal axis of the protrusion a radial distance sufficient to form a protrusion height of 1/16 to 1/8 inch above the generally cylindrical outer surface of the projection 18 are believed preferable. The engagement features advantageously have no sharp corners as may give rise to stress concentrations and induce cracking in the concrete. The engagement feature 18 on the projection 10 is believed desirable, but is optional.

Engagement features 18 may optionally be provided on a portion of the free end of the slip dowel 30 which is embedded in the concrete 32. Any such engagement feature on the free end of the slip dowel does not extend into the projection 10 so as to inhibit free movement of the slip dowel along the length of the projection 10 into which the dowel is inserted or sheathed during use.

The concrete form 12 is advantageously a 2×4 or 2×6 wooden stud, and preferably finished studs. The finished studs have cross-sectional dimensions about 0.5 inches smaller than the unfinished or rough cut stud dimension in the long dimension, and about ⅜ inches smaller in the shorter dimension. A finished 2×4 typically has a cross-section of 1⅝×3½ inches, and a finished 2×6 typically has a cross-section of 1⅝×5½ inches.

The rectangular baseplate 14 advantageously has sides 2 to 2.5 inches long each side, with a thickness of 0.03 to 0.25 inches and preferably between 1/64 and ¼ inch when made of polypropylene or other suitable plastic or polymer that does not split or crack when the fastener is driven through the baseplate and into the form in a single strike of a hammer or hammer stapler. A baseplate made of polypropylene having a thickness of 1/64 to ¼ inch is believed suitable, with a thickness of 1/64 to 3/16 preferred. Thicknesses of 0.015 to 0.3 inches are believed suitable with ranges of 0.015 to 0.3 inches more preferred. Other polymer materials that allow fastener 16 to be driven manually through the baseplate by a single hammer blow or a manual hammer stapler, without cracking or breaking, are believed suitable.

Advantageously, the square baseplate 14 allows placement on the form 12 with the upper edge of the baseplate located at least 0.5 inches from the top of the form 12. A circular baseplate 14 advantageously has a diameter of 2-2.5 inches. The circular baseplate may be positioned closer to the top of the form 12 because it does not have an extended length extending parallel to the top of the form and thus the intervening concrete 26 is stronger and less susceptible to cracking induced by the baseplate. While rectangular and circular baseplates are preferred, other shapes can be used, with plates having four to eight flat sides believed preferable, and with plates having circular or oval curved outer peripheries believed suitable.

The fasteners 16 advantageously have a length of 0.2 to 0.7 inches, with lengths of ¼ to 9/16 inches preferred, and a length of about 0.4 inches (give or take 0.05) preferred. 9/16, wide crown staples are believed suitable. The shaft thickness is sufficient to allow full installation of the fastener in one swing of a manual installation tool, such as a hammer or hammer stapler, with the fastener head against the baseplate. Electric or air powered staplers may be used but are not believed as desirable as mechanical hammer staplers. Advantageously, three or more fasteners 16 are used, one toward the top of the baseplate 14, partially above the projection 10, and one on each opposing side of the projection. The fasteners are long enough to hold the baseplate and projection in position, but short enough that the concrete form 12

The slip dowel 30 is preferably a smooth steel rod, but it is contemplated that the slip dowel 30 may be made of aluminum, iron, stainless steel, fiberglass or any other suitable metal or metal alloy or material strong enough to endure longitudinal or vertical compression and expansion forces that may occur between sections of concrete without bending enough to crack the concrete. AR-Glass, R-Glass, S2 Glass fiber and Z-Glass are various fibers and fiberglass believed suitable for use as slip dowels. Further, the entire outer surface of the slip dowel 30 need not be smooth. For example, a length portion of the slip dowel 30 intended for entrainment in the wet concrete may include a ribbed outer surface, similar to the outer surface of typical re-bar, or include other features on the outer surface such that the slip dowel is unsmooth such that when entrained in concrete that hardens, the unsmooth features will inhibit the slip dowel from movement along its axis.

The ability for the slip dowels 30 to slide freely within the sheaths formed by projection 12 allows the interface between the first concrete 26 and the second concrete 32 to remain aligned, thus preventing faulting, i.e., undesirable skewing of the hardened first concrete section 26 and the second hardened concrete section 32 at the cold joint betw3*en* those concrete sections. Skewing at the cold joint may damage the concrete, weaken the concrete, or result in undesirable aesthetics.

In use, the ground is leveled and prepared by any tamping, addition of sand or other steps appropriate to the particular pour. One or more concrete forms 12 are arranged around the periphery of the planned pour and fastened to the ground, usually by stakes. At least one concrete form 12 is used, as sometimes adjacent slabs of concrete or other structures provide the forms that define the periphery of the concrete slab. Structural steel reinforcing or rebar is placed as desired within the area of the pour inside the concrete forms. The rebar is typically arranged in a rectangular gridwork with regular spacings between the rebar crossings. The spacing and thickness of the rebar and the slab thickness depend on the loads expected to be carried by the concrete.

The projections 10 are fastened to the concrete forms 12 by passing fasteners 16 through baseplate 12 and into the vertical side 13 of the concrete form. Typically a construction worker holds the baseplate 12 or projection 10 to position the baseplate on the form, visually estimating the distance between the top of the form and the top of the baseplate at the de sired spacing (usually at least 0.5 inches). A hammer stapler can drive a fastener 16 into the baseplate to tack the baseplate to the concrete form, and the projection can be held until two or three more fasteners are placed to hold the projection to the form. Sufficient fasteners 16 are used to not only hold the projection perpendicular to the vertical side 13 of the concrete form 12, but to hold the periphery of the baseplate 14 against the vertical side 13 to block concrete from flowing between the form and the baseplate. Although, a little concrete and even fine aggregate, such as sand, may pass between the baseplate and the form, it typically is not enough to block access to the opening 24 in the baseplate into which the slip dowel 30 is inserted.

A series of projections 10 are fastened to the concrete form, with the projections spaced a distance apart corresponding to the rebar gridwork spacing, typically about 18 inches. The construction workers can visually align the projections 10 to align with a projecting end of a rebar, or they can place the projections 10 to be located between the projecting ends of two adjacent rebar. In some cases, rebar ends are placed vertically above each other and the projection 10 is located to extend between the two projecting ends to provide a stronger interlock joint between adjacent slabs. The sequence of the above steps may vary, depending on equipment and worker availability and depending on the design of the concrete slab to be poured.

The first concrete 26 is then poured, the slab has its exterior (top) surface leveled and then finished as desired.

After the first concrete 26 has hardened sufficiently, the at least one concrete form 12, and more typically the plurality of concrete forms 12 are removed by pulling them laterally away from the edges of the concrete, leaving the baseplates 12 and projections 10 embedded in the first concrete with the ends of the fasteners exposed. Advantageously, each fastener 16 has a fastener head abutting the baseplate 14 and restraining the fastener from being pulled through the baseplate 14, and each fastener has no barbed ends or laterally extending protrusions that retain the fastener in the concrete form 12 (e.g., screw threads), so the forms are easily stripped from the hardened first concrete so as to leave the fastener heads and baseplates 14 embedded in the first concrete 26. As the stripped concrete forms 12 have no fasteners or large holes in them as required by prior art cold joint methods, the concrete forms may be reused as concrete forms or used for other purposes. The ends of the fasteners 16 extending from the edge of the first concrete 26 may optionally be bent against the first concrete by manual tools or by stepping on them with a person's booted foot, but the fasteners are advantageously weak enough and short enough that they do not penetrate with boots of construction workers if accidently kicked. The exposed edges of the first concrete form one side of a cold joint. In some cases an expansion strip may be placed along an exposed edge of the first concrete with the adjoining second concrete poured against the expansion strip.

One or more edges of the first concrete 26, when hardened, may comprise a concrete form having a height the same as that of the first concrete's top surface. A construction worker then inserts the slip dowel 30 through the openings 22, 24 of the tubular projection 10 and baseplate 14, into the inside of each of the respective tubular projections 10. The above described steps are then repeated to form a second concrete 32 adjoining one or more sides of the first concrete 26, with the wet, second concrete poured against the hardened side of the first concrete (with or without the expansion strip interposed between adjoining concrete slabs).

Optionally, the concrete form 12 may be pre-marked with a line extending along the length of its vertical side 13 to indicate the spacing and location of the top of the baseplate. A line along the top and bottom of the vertical side 13 allows the concrete form 12 to be placed with either edge by the ground and still provide the desired spacing guidance. A painted center strip along the length of the concrete form 12 could alternatively create lines indicating the area within which the baseplate could be placed. The projections 10 can be fastened to the concrete form 12 before or after the forms are placed against the ground to define the periphery of the poured concrete slab.

The detailed description set forth above in connection with the drawings is intended as a description of some, but not all, of contemplated embodiments of the disclosure, and is not intended to represent the only form in which the present disclosure may be constructed or utilized. The description sets forth the functions and the sequence of steps for developing and operating the disclosure in connection with the illustrated embodiments.

It is to be understood, however, that the same or equivalent functions and sequences may be accomplished by different embodiments that are also intended to be encompassed within the spirit and scope of the disclosure. It is further understood that the use of relational terms such as first and second, top and bottom, and the like are used solely to distinguish one entity from another entity without necessarily requiring or implying any actual such relationship or order between such entities.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, the description taken with the drawings making apparent to those skilled in the art how the several forms of the present disclosure may be embodied in practice.

What is claimed is:

1. A concrete dowel placement system comprising:

a 2×4 or 4×6 stud having a stud length with opposing first and second side walls and opposing top and bottom edge walls;

a plurality of baseplates each having opposing front and back sides with a thickness of between 0.03 and 0.25 inches and made of a polymer which does not split or crack when a fastener is forced through the baseplate, each baseplate having an outer periphery which is located between the top and bottom edge walls of the stud and 0.5 inches or more from the top edge wall of the stud;

multiple fasteners configured to be forced through each of different ones of the baseplates to fasten the baseplate to the first side wall of the stud to form a seal that inhibits entry of poured concrete between the baseplate and stud, each fastener being configured to have has a fastener length which extends into the stud a distance of at least inch and no more than 1 inch; and a plurality of tubular projections, each tubular projection being integrally formed with, and extending from, a respective one of the plurality of baseplates along a longitudinal axis that is substantially perpendicular to the front side of the baseplate from which the projection extends, each tubular projection having a length of 4 to 9 inches with a closed distal end portion and having a hollow interior configured to receive a cylindrical shaft 0.2 to 0.4 inches in diameter;

wherein each baseplate is formed with no holes radially outward of the respective tubular projection prior to the fasteners being forced through the respective baseplate.

2. The system of claim 1, wherein the fasteners are configured to extend a distance of 0.3 to 0.5 inches into the stud and comprise nails or staples or both, and wherein the hollow interior is configured to receive a shaft 0.2 to 0.3 inches in diameter.

3. The system of claim 2, wherein the tubular projections have engagement features to better entrain the tubular projections in the concrete, and wherein the tubular projections are spaced at 18 inch intervals along the stud length.

4. The system of claim 2, wherein there are only three staples holding each of the baseplates to the stud.

5. The system of claim 1, further comprising a rib extending radially outward from an outer surface of each tubular projection.

6. The system of claim 5, wherein the rib extends over the outer surface to define a helical shape.

7. The system of claim 5, wherein the distal end portion of the tubular projection is chamfered.

8. The system of claim 7, wherein the distal end portion of the tubular projection is chamfered at 30°-45°.

9. A concrete dowel placement system for use with a 2×4 or 4×6 stud having a stud length with opposing first and second stud walls and opposing top and bottom edge walls, the concrete dowel placement system comprising:

a plurality of baseplates each having opposing front and back sides with a thickness of between 0.03 and 0.25 inches and made of a polymer which does not split or crack when a fastener is forced through the baseplate, each baseplate having an outer periphery which is positionable between the top and bottom edge walls of the stud and 0.5 inches or more from the top edge wall of the stud;

multiple fasteners configured to be forced through each of different ones of the baseplates to fasten the baseplate to the first stud wall of the stud to form a seal that inhibits entry of poured concrete between the baseplate and stud; and a plurality of tubular projections, each tubular projection being integrally formed with, and extending from a respective one of the plurality of baseplates along a longitudinal axis that is substantially perpendicular to the front side of the baseplate from which the projection extends, each tubular projection having a length of 4 to 9 inches with a closed distal end portion and having a hollow interior configured to receive a cylindrical shaft 0.2 to 0.4 inches in diameter;

wherein each baseplate is formed with no holes radially outward of the respective tubular projection prior to the fasteners being forced through the respective baseplate.

10. The system of claim 9, wherein the fasteners are configured to extend a distance of 0.3 to 0.5 inches into the stud and comprise nails or staples or both, and wherein the hollow interior is configured to receive a shaft 0.2 to 0.3 inches in diameter.

11. The system of claim 10, wherein the tubular projections have engagement features to better entrain the tubular projections in the concrete, and wherein the tubular projections are positionable at 18 inch intervals along the stud length.

12. The system of claim 10, wherein each baseplate is configured to be attachable to the stud with only three staples.

13. The system of claim 9, further comprising a rib extending radially outward from an outer surface of each tubular projection.

14. The system of claim 13, wherein the rib extends over the outer surface to define a helical shape.

15. The system of claim 9, wherein the distal end portion of the tubular projection is chamfered.

16. The system of claim 15, wherein the distal end portion of the tubular projection is chamfered at 30°-45°.

17. A concrete dowel placement device for use with a stud having a stud length with opposing first and second stud walls and opposing top and bottom edge walls, the concrete dowel placement device comprising:

a baseplate having opposing front and back sides with a thickness of between 0.03 and 0.25 inches and made of a polymer;

multiple fasteners configured to be forceable through the baseplate to fasten the baseplate to the first stud wall of the stud to form a seal that inhibits entry of poured concrete between the baseplate and stud; and a tubular projection integrally formed with, and extending from the baseplate along a longitudinal axis that is substantially perpendicular to the front side of the baseplate, the tubular projection having a length of 4 to 9 inches with a closed distal end portion and having a hollow interior configured to receive a cylindrical shaft 0.2 to 0.4 inches in diameter;

wherein the baseplate is formed with no holes radially outward of the tubular projection prior to the fasteners being forced through the baseplate.

18. The system of claim 17, further comprising a rib extending radially outward from an outer surface of each tubular projection.

19. The system of claim 17, wherein the baseplate has an outer periphery which is configured to be positionable between the top and bottom edge walls of the stud and 0.5 inches or more from the top edge wall of the stud.

20. The system of claim 17, wherein each fastener has a fastener length configured to be extendable into the stud a distance of at least ¼inch and no more than 1 inch.

* * * * *